US008236396B2

(12) United States Patent
Saito

(10) Patent No.: US 8,236,396 B2
(45) Date of Patent: Aug. 7, 2012

(54) INTERMEDIATE TRANSFER MEMBER, MANUFACTURING APPARATUS OF INTERMEDIATE TRANSFER MEMBER, MANUFACTURING METHOD OF INTERMEDIATE TRANSFER MEMBER AND IMAGE FORMING APPARATUS

(75) Inventor: Atsushi Saito, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1287 days.

(21) Appl. No.: 11/915,755

(22) PCT Filed: May 25, 2006

(86) PCT No.: PCT/JP2006/310422

§ 371 (c)(1),
(2), (4) Date: Nov. 28, 2007

(87) PCT Pub. No.: WO2006/129543

PCT Pub. Date: Dec. 7, 2006

(65) Prior Publication Data

US 2009/0129829 A1 May 21, 2009

(30) Foreign Application Priority Data

Jun. 1, 2005 (JP) ..... 2005-161069

(51) Int. Cl.
*B41M 5/40* (2006.01)

(52) U.S. Cl. ..... 428/32.61; 428/32.77; 428/32.8; 428/217; 399/308

(58) Field of Classification Search ..... 428/32.61, 428/32.77, 32.8, 217; 399/308
See application file for complete search history.

(56) References Cited

U.S. PATENT DOCUMENTS 5,689,787 A * 11/1997 Tombs et al. ..... 399/308

FOREIGN PATENT DOCUMENTS

| | | |
|---|---|---|
| JP | 9212004 | 8/1997 |
| JP | 2002174958 | 6/2002 |
| JP | 2003165857 | 6/2003 |
| JP | 2006091539 | 4/2006 |

* cited by examiner

*Primary Examiner* — Betelhem Shewareged
(74) *Attorney, Agent, or Firm* — Lucas & Mercanti, LLP

(57) ABSTRACT

An intermediate transfer member which holds a toner image transferred from a first toner image carrier and secondarily transfers the toner image to a surface of an image forming material, wherein the intermediate transfer member comprises a substrate having thereon at least a hard carbon-containing layer.

6 Claims, 6 Drawing Sheets

INTERMEDIATE TRANSFER MEMBER, MANUFACTURING APPARATUS OF INTERMEDIATE TRANSFER MEMBER, MANUFACTURING METHOD OF INTERMEDIATE TRANSFER MEMBER AND IMAGE FORMING APPARATUS

FIELD OF THE INVENTION

The present invention relates to an intermediate transfer member, a manufacturing apparatus of an intermediate transfer member, a manufacturing method or an intermediate transfer member and an image forming apparatus provided with an intermediate transfer member.

BACKGROUND OF THE INVENTION

Conventionally, copiers, printers, facsimile machines, for example, which use an electrophotographic method are known. Image forming devices of these are known as those provided with an intermediate transfer member which receives a toner image that is primarily transferred onto the intermediate transfer member from a first tone image carrier, carries the transferred toner image, and further secondarily transfers the toner image to, for example, a recording paper.

As such an intermediate transfer member, an intermediate transfer member is presented which is aimed at improving the efficiency of transferring to such as a recording medium by coating the surface of the intermediate transfer member with, for example, silicon oxide, aluminum oxide so as to improve the peelability of a toner image (for example, refer to Patent Document 1).

Patent Document 1: Japanese Patent Application Publication (hereafter referred to as JP-A) No. 9-212004

DISCLOSURE OF THE INVENTION

Problems to be Solved by the Invention

However, currently, an image forming apparatus provided with an intermediate transfer member is almost incapable of transferring 100% of a tone image through second transferring, and requires, for example, a cleaning device for wiping off toner remaining on the intermediate transfer member.

An intermediate transfer member disclosed in Patent Document 1 has a problem that the toner transfer rate through the secondary transfer and durability have not been fully sufficient, and has a problem of requiring a large equipment, such as a vacuum unit, to form silicon oxide material by vacuum evaporation or such as aluminum oxide material by sputtering.

To address the above described problems, an object of the invention is to provide an intermediate transfer member exhibiting a high transferability, a high cleaning performance and a high durability; a manufacturing apparatus of intermediate transfer member, in which no large equipment such as a vacuum apparatus is required; and an image forming apparatus provided with such an intermediate transfer member.

Means for Solving the Problems

The above described object in accordance with the present invention is attained by the followings.

(1) An intermediate transfer member which holds a toner image transferred from a first toner image carrier and secondarily transfers the toner image to a surface of an image forming material, wherein the intermediate transfer member comprises a substrate having thereon at least a hard carbon-containing layer.

(2) The intermediate transfer member of Item (1), wherein an outer surface of the intermediate transfer member is the hard carbon-containing layer.

(3) The intermediate transfer member of Item (1) or (2), wherein the hard carbon-containing layer comprises at least one film selected from the group consisting of: an amorphous carbon film, a hydrogenated amorphous carbon film, a tetrahedral amorphous carbon film, a nitrogen-containing amorphous carbon film and a metal-containing amorphous carbon film.

(4) The intermediate transfer member of any one of Items (1) to (3), wherein the hard carbon-containing layer is deposited and formed on a surface of the substrate by:

exciting at least a raw material gas for forming the hard carbon-containing layer between a pair of electrodes by a plasma discharge generated in a vicinity of the surface of the substrate; and exposing the surface of the substrate to the excited raw material gas.

(5) The intermediate transfer member of any one of Items (1) to (3), wherein the hard carbon-containing layer is deposited and formed on a surface of the substrate by:

exciting at least a raw material gas for forming the hard carbon-containing layer by a plasma discharge: and jetting the excited raw material gas onto the surface of the substrate.

(6) The intermediate transfer member of Item (4) or (5), wherein the hard carbon-containing layer is deposited and formed at an atmospheric pressure or a near atmospheric pressure.

(7) A manufacturing apparatus of an intermediate transfer member having an endless belt shape, the intermediate transfer member comprising at least a hard carbon-containing layer on a substrate, and the manufacturing apparatus comprising a first film forming device, wherein the first film forming device forms the hard carbon-containing layer on the substrate:

the first film forming device comprises:

at least a pair of rollers which attachably and detachably hang and rotate the substrate, one of the pair of rollers working as a roller electrode; and a fixed electrode facing the roller electrode through the substrate, wherein the roller electrode and the fixed electrode forms a pair of electrodes by which a plasma discharge is carried out.

(8) The manufacturing apparatus of the intermediate transfer member of Item (7), wherein a surface of the substrate is exposed to a plasma generated in a facing area between the roller electrode and the fixed electrode so as to deposit and form the hard carbon-containing layer.

(9) A manufacturing apparatus of an intermediate transfer member having an endless belt shape, the intermediate transfer member comprising at least a hard carbon-containing layer on a substrate, and the manufacturing apparatus comprising a second film forming device, wherein the second film forming device forms the hard carbon-containing layer on the substrate:

the second film forming device comprises:

at least a pair of rollers which attachably and detachably hang and rotate the substrate; and at least a pair of fixed electrodes facing one of the pair of rollers, wherein the pair of fixed electrodes carry out a plasma discharge.

(10) The manufacturing apparatus of the intermediate transfer member of Item (9), wherein a plasma generated in a facing area of the pair of fixed electrodes is jetted to a surface of the substrate so as to deposit and form the hard carbon-containing layer.

(11) A manufacturing apparatus of an intermediate transfer member having an endless belt shape, the intermediate transfer member comprising at least a hard carbon-containing layer on a substrate, and the manufacturing apparatus comprising a third film forming device, wherein the third film forming device forms the hard carbon-containing layer on the substrate, and the third film forming device comprises at least two pairs of rollers, each pair of rollers attachably and detachably hanging and rotating the substrate, whereby a plurality of substrates are hung on the pairs of rollers, wherein one of one pair of rollers works as an electrode; and one of the other pair of rollers works as another electrodes, wherein the one of one pair of rollers and the one of the other pair of rollers face each other at a predetermined distance; and the one of one pair of rollers and the one of the other pair of rollers form a pair of electrodes which carry out a plasma discharge.

(12) The manufacturing apparatus of an intermediate transfer member of Item (11), wherein the plurality of substrates are exposed to plasma generated in a facing area between the one of one pair of rollers and the one of the other pair of rollers so as to deposit and form the hard carbon-containing layer.

(13) The manufacturing apparatus of the intermediate transfer member of Item (7) or (8) having:

a plurality of power sources each providing a different voltage and a different frequency, the plurality of power sources each being respectively connected to the one of the pair of rollers and to the fixed electrode, wherein the hard carbon-containing layer is deposited and formed by a plasmatized mixed gas of at least a discharging gas and a raw material gas, the plasmatized mixed gas being formed by an electric field generated between the one of the pair of rollers and the fixed electrode by superposing the different frequencies.

(14) The manufacturing apparatus of the intermediate transfer member of Item (7) or (8) having:

a power source connected to at least one of the one of the pair of rollers and the fixed electrode, wherein the hard carbon-containing layer is deposited and formed by a plasmatized mixed gas of at least a discharging gas and a raw material gas, the plasmatized mixed gas being formed by an electric field having a single frequency generated between the one of the pair of rollers and the fixed electrode.

(15) The manufacturing apparatus of the intermediate transfer member of Item (9) or (10) having:

a plurality of power sources each providing a different voltage and a different frequency, the plurality of power sources each being respectively connected to each of the pair of fixed electrodes, wherein the hard carbon-containing layer is deposited and formed by a plasmatized mixed gas of at least a discharging gas and a raw material gas, the plasmatized mixed gas being formed by an electric field generated between the pair of fixed electrodes by superposing the different frequencies.

(16) The manufacturing apparatus of the intermediate transfer member of Item (9) or (10) having:

a power source connected to at least one of the pair of fixed electrodes, wherein the hard carbon-containing layer is deposited and formed by a plasmatized mixed gas of at least a discharging gas and a raw material gas, the plasmatized mixed gas being formed by an electric field having a single frequency generated between the pair of fixed electrodes.

(17) The manufacturing apparatus of the intermediate transfer member of Item (11) or (12) having:

a plurality of power sources each providing a different voltage and a different frequency, the plurality of power sources each being respectively connected to the one of the pair of rollers and the one of the other pair of rollers, wherein the hard carbon-containing layer is deposited and formed by a plasmatized mixed gas of at least a discharging gas and a raw material gas, the plasmatized mixed gas being formed by an electric field generated between the one of the pair of rollers and the one of the other pair of rollers by superposing the different frequencies.

(18) The manufacturing apparatus of the intermediate transfer member of Item (11) or (12) having:

a power source connected to at least one of the one of the pair of rollers and the one of the other pair of rollers, wherein the hard carbon-containing layer is deposited and formed by a plasmatized mixed gas of at least a discharging gas and a raw material gas, the plasmatized mixed gas being formed by an electric field having a single frequency generated between the one of the pair of rollers and the one of the other pair of rollers.

(19) The manufacturing apparatus of the intermediate transfer member of any one of Items (7) or (18), wherein the hard carbon-containing layer is deposited and formed at an atmospheric pressure or at a near atmospheric pressure.

(20) The manufacturing apparatus of the intermediate transfer member of any one of Items (7) or (19), wherein the manufacturing apparatus forms the hard carbon-containing layer comprising at least one film selected from the group consisting of an amorphous carbon film, a hydrated amorphous carbon films a tetrahedral amorphous carbon film, a nitrogen-containing amorphous carbon film and a metal-containing amorphous carbon film.

(21) A method of manufacturing the intermediate transfer member comprising at least the step of:

forming at least a layer on a substrate, wherein the method comprises a film forming step of forming a hard carbon-containing layer as a final step.

(22) The method of Item (21), wherein the hard carbon-containing layer comprising at least one film selected from the group consisting of an amorphous carbon film, a hydrated amorphous carbon film, a tetrahedral amorphous carbon film, a nitrogen-containing amorphous carbon film and a metal-containing amorphous carbon film is formed in the film forming step.

(23) The method of Item (21) or (22), wherein the film forming step is a step in which the hard carbon-containing layer is formed on a surface of the substrate by exciting at least a raw material gas for the hard carbon-containing layer by a plasma discharge generated in a vicinity of the surface of the substrate and by exposing the surface of the substrate to the excited raw material gas.

(24) The method of Item (21) or (22), wherein the film forming step is a step in which the hard carbon-containing layer is formed on a surface of the substrate by exciting at least a raw material gas for the hard carbon-containing layer by a plasma discharge and jetting the excited raw material gas onto the surface of the substrate

(25) An image forming apparatus comprising the intermediate transfer member of any one of Items (1) or (6).

EFFECTS OF THE INVENTION

According to the invention, effects as follows will be attained.

An intermediate transfer member in accordance with any one of items (1) to (6) provided with a hard carbon-containing layer that includes at least one film, in its outer layer, selected from an amorphous carbon film, hydrogenated amorphous carbon film, tetrahedral amorphous carbon film, nitrogen-containing amorphous carbon film, metal-containing amorphous carbon film realizes an intermediate transfer member with a high transferability and a high cleaning performance and a high durability.

It is possible to realize a manufacturing apparatus in accordance with any one of items (7) to (20) for an intermediate transfer member, which requires no large equipment, such as a vacuum apparatus, and manufactures an intermediate transfer member having the above described effects by forming a hard carbon-containing layer including at least one film selected from an amorphous carbon film, hydrogenated amorphous carbon film, tetrahedral amorphous carbon film, nitrogen-containing amorphous carbon film, metal-containing amorphous carbon film, at an atmospheric pressure or a near atmospheric pressure by a plasma CVS device.

It is possible to realize a manufacturing method, in accordance with any one of items (21) to (24), of an intermediate transfer member with a high transferability and a high cleaning performance and a high durability, by forming a hard carbon-containing layer including at least one film selected from an amorphous carbon film, hydrogenated amorphous carbon film, tetrahedral amorphous carbon film, nitrogen-containing amorphous carbon film, metal-containing amorphous carbon film, through a process of performing plasma discharge at an atmospheric pressure or a near atmospheric pressure.

It is possible to provide an image forming apparatus exhibiting a high transferability, a high cleaning performance and a high durability, by having an intermediate transfer member in accordance with any one of items (1) to (6).

DESCRIPTION OF REFERENCE SYMBOLS

Figure 1:
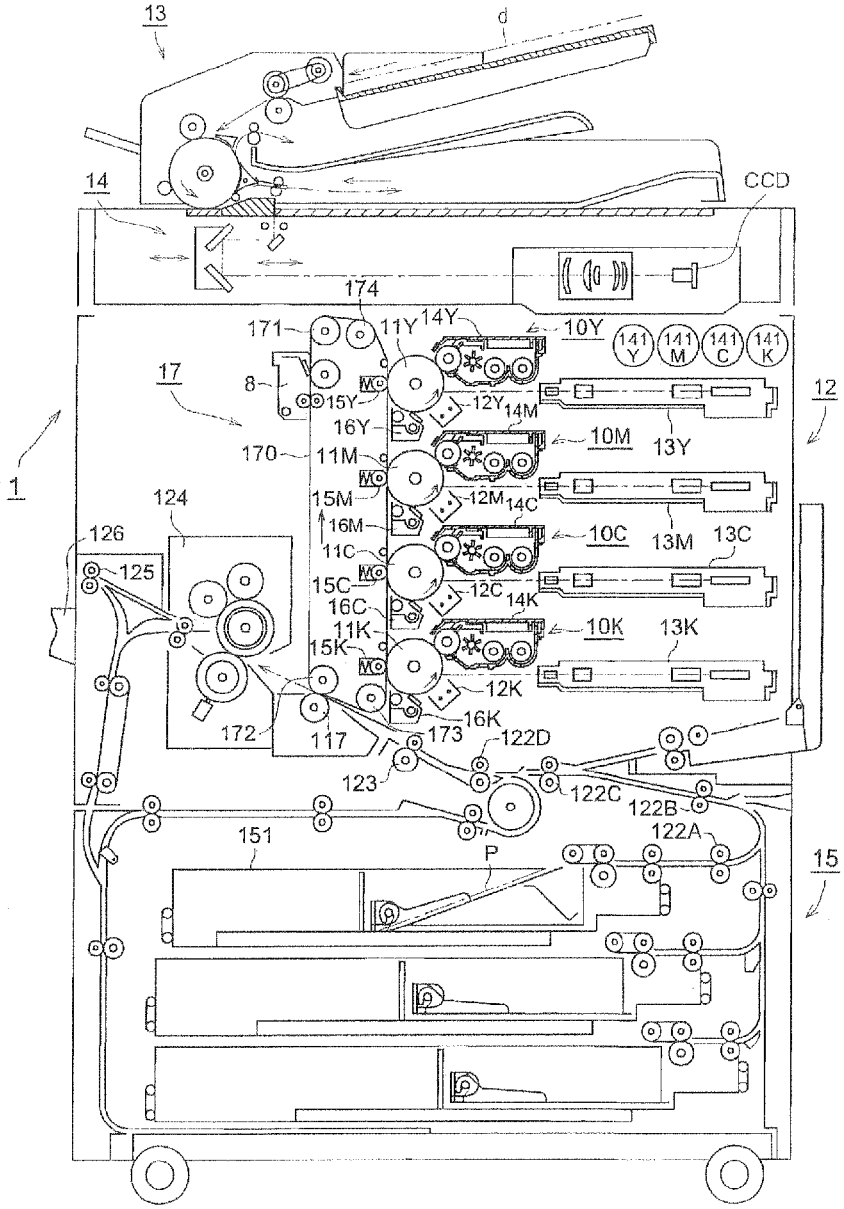
FIG. 1 is a cross-sectional structure view showing an example of a color image forming apparatus.

1 color image forming apparatus
2 manufacturing apparatus of intermediate transfer member
3 atmospheric pressure plasma CVD device
4 atmospheric pressure plasma device
17 intermediate transfer member unit
20 roll electrode
21 fixed electrode
23 electric discharge space
24 mixed gas supply device
25 first power source
26 second power source
41 thin film forming area
117 secondary transfer roller
170 intermediate transfer belt
175 substrate
175 hard carbon-containing layer
201 driven roller

BEST MODE FOR PRACTICING THE INVENTION

An embodiment in accordance with the present invention will be described below. However, the description below does not limit the technical scope nor definition of words of the claims thereto.

An intermediate transfer member in accordance with the invention is preferably used in an image forming apparatus, such as an electrophotographic type copier, printer and facsimile. Any type of an transfer body is applicable as long as a toner image held on the surface of a photoreceptor is primarily transferred to the surface of the transfer body, the transfer body holds the transferred toner image, and the transfer body secondarily transfers the held toner image to the surface of an image forming material, such as a recording sheet, onto which to transfer the image, wherein the intermediate transfer member may be in a belt form or in a drum shape.

First, an image forming apparatus provided with an intermediate transfer member in accordance with the invention will be described, taking an example of a tandem type full-color copier.

FIG. 1 is a cross-sectional structure view showing an example of a color image forming apparatus.

The color image forming apparatus 1 is a tandem type full-color copier, and is provided with an automatic document conveying device 13, an original document reading device 14, plural exposure units 13Y, 13M, 13C and 13K, plural image forming sections 10Y, 10M, 10C and 10K, an intermediate transfer member unit 17, a sheet feeding unit 15 and a fixing unit 124.

On the top of the main body 12 of the image forming apparatus, disposed are the automatic document conveying device 13 and the original document reading device 14. An image of an original document "d" conveyed by the automatic document conveying device 13 is reflected and caused to form an image by an optical system of the image reading device 14, and the image is read by a line image sensor CCD.

An analog signal produced by photoelectric conversion of an image of an original document read by the line image sensor CCD is subjected, in an image processing section not shown, to analog processing, A/D conversion, shading calibration, image compression processing and the like, thereafter transmitted to the exposure units 13Y, 13M, 13C and 13K as digital image data of the respective colors, and then latent images of the image data of the respective colors are formed by the exposure units 13Y, 13K, 13C and 13Y on photoreceptors in a drum shape (hereinafter, also referred to as photoreceptors) as corresponding first image carriers.

The image forming sections 10Y, 10M, 10C and 10K are disposed in tandem in the vertical direction, and an intermediate transfer member (hereinafter, referred to as an intermediate transfer belt) 170, in accordance with the invention, which is a second image carrier being semiconductive and in an endless belt form is disposed on the left side, in the figure, of the photoreceptors 11Y, 11M, 11C and 11K, wherein the intermediate transfer belt 170 is wound around rollers 171, 172, 173 and 174 and thus circulatively tension-supported.

The intermediate transfer belt 170 in accordance with the invention is driven along the arrow direction through the roller 171 which is rotationally driven by a drive unit, not shown.

The image forming section 10Y for forming yellow colored images includes a charging unit 12Y, exposure unit 13Y, development unit 14Y, primary transfer roller 15Y as primary transfer means, and cleaning unit 16Y which are disposed around the photoreceptor 11Y.

The image forming section 10M for forming magenta colored images includes a photoreceptor 11M, charging unit 12M, exposure unit 13M, development unit 14M, primary transfer roller 15M as primary transfer means, and cleaning unit 16M.

The image forming section 10C for forming cyan colored images includes a photoreceptor 11C, charging unit 12C, exposure unit 13C, development unit 14C, primary transfer roller 15C as primary transfer means, and cleaning unit 16C.

The image forming section 10K for forming black colored images includes a photoreceptor 11K, charging unit 12K, exposure unit 13K, development unit 14K, primary transfer roller 15K as primary transfer means, and cleaning unit 16K.

Toner supply units 141Y, 141M, 141C and 141K supply new toner to the respective development units 14Y, 14M, 14C and 14K.

Herein, the primary transfer rollers 15Y, 15M, 15C and 15K are selectively operated by a control unit, not shown, corresponding to the type of an image, and press the intermediate transfer belt 170 against the respective photoreceptors 11Y, 11M, 11C and 11K so as to transfer an image from the photoreceptors.

In such a manner, the images in the respective colors formed on the photoreceptors 11Y, 11M, 11C and 11K by the image forming sections 10Y, 10M, 10C and 10K are sequentially transferred to the circulating intermediate transfer belt 170 by the primary transfer rollers 15Y, 15M, 15C and 15K so that a composite color image is formed.

That is, the toner images held on the surfaces of the photoreceptors are primarily transferred to the surface of the intermediate transfer belt, and the intermediate transfer belt holds the transferred toner image.

A recording sheet P as a recording medium stored in a sheet supply cassette 151 is fed by the sheet feeding unit 151, then conveyed to the secondary transfer roller 117 as secondary transfer means through plural intermediate rollers 122A, 122B, 122C, 122D and a registration roller 123, and then the composite toner image on the intermediate transfer member is transferred at a time onto the recording sheet P by the secondary transfer roller 117.

That is, the toner image held on the intermediate transfer member is secondarily transferred to the surface of an object on which to transfer the image.

Herein, a secondary transfer roller 117 presses the recording medium P against the intermediate transfer belt 170 only when the recording medium P passes the secondary transfer roller 117 so that the secondary transfer roller 117 performs secondary transfer.

The recording sheet P on which the color image has been transferred is subjected to fixing processing by a fixing device 124, and nipped by ejection rollers 125 to be loaded on an external ejection tray 126.

On the other hand, after the color image is transferred to the recording medium P by the secondary transfer roller 117, residual toner on the intermediate transfer belt 170 having curvature separated the recording sheet P is removed by a cleaning unit 8.

Herein, the intermediate transfer member may be replaced by a rotating intermediate transfer drum in a drum shape as described above.

Next, the structures of the primary transfer rollers 15Y, 15M, 15C and 15K as first transfer units in contact with the intermediate transfer belt 170, and the structure of the secondary transfer roller 117 will be described.

The primary transfer rollers 15Y, 15M, 15C and 15K are formed, for example, by coating a circumferential surface of a conductive core metal of stainless or the like with an outer diameter of 8 mm, with a semiconductive elastic rubber having a thickness of 5 mm and a rubber hardness in an approximate range from 20 to 70 degrees (Asker hardness C). Herein, the semiconductive elastic rubber is prepared by making a rubber material, such as polyurethane, EPDM, silicon or the like into a solid state or foam sponge state with a volume resistance in an approximate range from $10^5$ to $10^9$ Ω·cm, dispersing conductive filler, such as carbon, to the rubber material or having the rubber material contain an ionic conductive material.

The secondary transfer roller 117 is formed, for example, by coating a circumferential surface of a conductive core metal of stainless or the like with an outer diameter of 8 mm, with a semiconductive elastic rubber having a thickness of 5 mm and a rubber hardness in an approximate range from 20 to 70 degrees (Acker hardness C). Herein, the semiconductive elastic rubber is prepared by making a rubber material, such as polyurethane, EPDM, silicon or the like into a solid state or foam sponge state with a volume resistance in an approximate range from $10^5$ to $10^9$ Ω·cm, dispersing conductive filler, such as carbon, to the rubber material or having the rubber material contain an ionic conductive material.

Herein, the secondary transfer roller 117 is different from the primary transfer rollers 15Y, 15M, 15C and 15K in that toner can contact the secondary transfer roller in a state where no recording sheet P is present. Accordingly, the surface of the secondary transfer roller 117 is preferably coated with a material having a sufficient separatability, such as a semiconductive fluorine resin, urethane resin or the like. The secondary transfer roller 117 is formed by coating a circumferential surface of a conductive core metal of stainless or the like, with a semiconductive material having a thickness in an approximate range from 0.05 to 0.5 mm. Herein, the semiconductive material is prepared by dispersing conductive filler, such as carbon, to a rubber or resin material, such as polyurethane, EPDM, silicon or the like, or having the rubber or resin material contain an ionic conductive material.

An intermediate transfer member in accordance with the invention will be described below, taking an example of the intermediate transfer belt 170.

Figure 2:
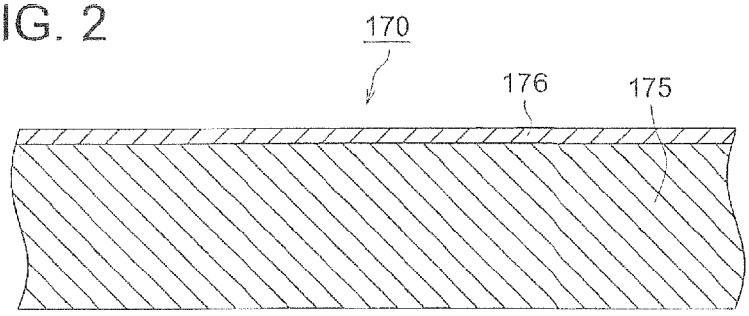
FIG. 2 is a conceptual cross-sectional view showing the layer structure of an intermediate transfer member.

FIG. 2 is a conceptual cross-sectional view showing the layer structure of the intermediate transfer member.

The intermediate transfer belt 170 includes a substrate 175 and at least a hard carbon-containing layer (DLC (diamond-like carbon) layer) 176 formed on the surface of the substrate 175.

The hard carbon-containing layer has a carbon concentration of 30 to 100% in the composition, hardness of 5 to 50 Gpa, and density of 1.2 to 3.2 g/cm$^3$. The hard carbon-containing layer preferably has a film thickness of 10 to 1000 nm and a refractive index of 2 to 2.8.

The substrate 171 is an endless belt with an approximate volume resistance of $10^6$ to $10^{12}$ Ω·cm. The substrate 171 is prepared, for example, by dispersing a conductive filler, such as carbon, or by incorporating an ionic conductive material, in: a resin material, for example, polycarbonate (PC), polyimide (PI), polyamide-imide (PAI), polyvinylidene fluoride (PVDF), polyphenylene sulfide (PPS), ethylene-tetrafluoroethylene (ETFE) copolymer; or a rubber material, for example, EPDM, NBR, CR and polyurethane. More preferably, polycarbonate (PC), polyimide (PI), or polyphenylene sulfide (PPS) is employed. The thickness is set to an approximate range from 50 to 200 μm for a resin material and in an approximate range from 300 to 700 μm for a rubber material.

Herein, the intermediate transfer belt 170 may be provided with another layer between the substrate 175 and the hard carbon-containing layer 176, wherein the hard carbon-containing layer 176 is arranged as the outermost layer A hard carbon-containing film of the present invention can be formed by a chemical vapor deposition (CVD) method, which may be any one of vacuum CVD method, atmospheric pressure CVD method and thermal CVD method. However, atmospheric pressure CVD is preferable which allows forming a hard-carbon containing film at a low temperature, with a high productivity, and with a high film quality.

Further, in a point of view of depositing a layer that contains carbon of, for example, an amorphous carbon film, hydrogenated amorphous carbon film, tetrahedral amorphous carbon film, nitrogen-containing amorphous carbon film and metal-containing amorphous carbon film, the hard carbon-containing layer 176 is preferably formed by plasma CVD that deposits and forms a film corresponding to a raw material gas by plasmatizing a mixed gas of at least discharging gas and the raw material gas, and especially by a plasma CVD performed at an atmospheric pressure or at a near atmospheric pressure.

The atmospheric pressure or the near atmospheric pressure is in an approximate range from 20 kPa to 110 kPa, and preferably in a range from 93 kPa to 104 kPa to obtain excellent effects of the present invention.

An apparatus, method and used gas will be described, taking an example of a case of forming the hard carbon-containing layer of the intermediate transfer member by the atmospheric pressure plasma CVD.

Figure 3:
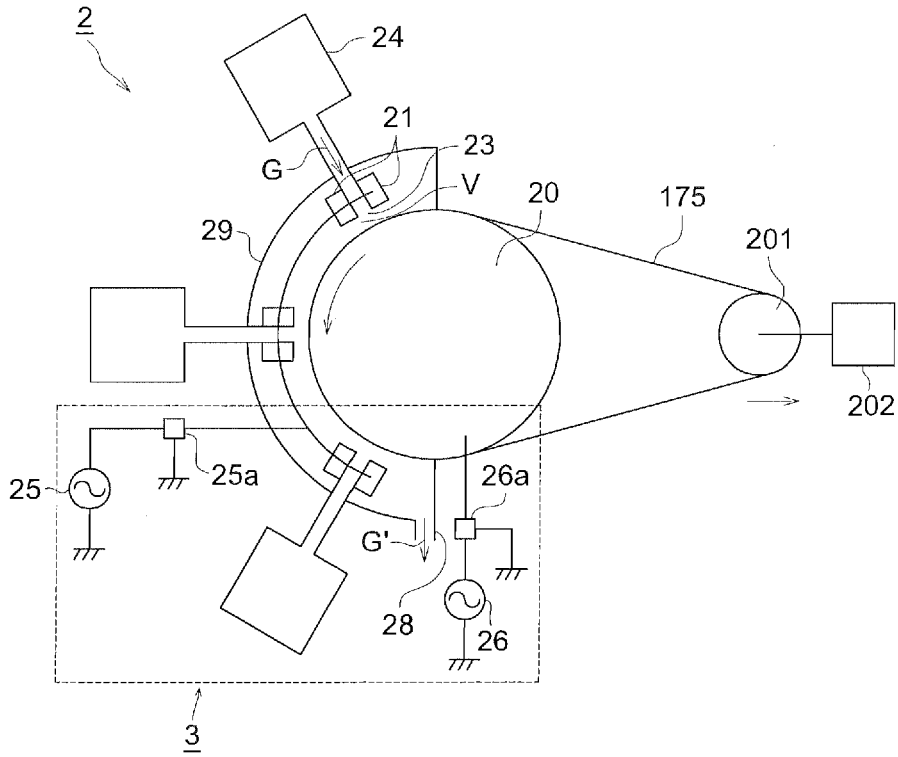
FIG. 3 is an illustration of a first manufacturing apparatus for manufacturing an intermediate transfer member.

FIG. 3 is an illustration of a first manufacturing apparatus for manufacturing an intermediate transfer member.

A manufacturing apparatus 2 of an intermediate transfer member (a direct type in which the electric discharge space and the thin film depositing area are substantially the same) which forms a hard carbon-containing layer on a substrate, includes: an roll electrode 20 that hangs a substrate 175 of an endless belt shaped intermediate transfer member and rotates in the arrow direction; a driven roller 201; and an atmospheric pressure plasma CVD device 3 which is a film forming device for forming a hard carbon-containing layer on the surface of a substrate.

The atmospheric pressure plasma CVD device 3 includes at least one set of fixed electrode 21 disposed along the outer circumference of the roll electrode 20; an electric discharge space 23 which is a facing area between the fixed electrode 21 and the roll electrode 20 where electric discharge is performed; a mixed gas supply device 24 which produces a mixed gas G of at least a raw material gas and a discharging gas to supply the mixed gas G to the discharge space 23; an electric discharge container 29 which reduces air flow into, for example, the discharge space 23; a first power source 25 connected to the roll electrode 20; a second power source 26 connected to the fixed electrode 21; and a gas exhaustion section 28 for exhausting gas G' having been used out.

The mixed gas supply device 24 supplies a mixed gas of a raw material gas and nitrogen gas or a rare gas such as argon gas, to the discharge space 23, the raw material gas forming at least one film selected from an amorphous carbon film, hydrogenated amorphous carbon film, tetrahedral amorphous carbon film, nitrogen-containing amorphous carbon film, metal-containing amorphous carbon film.

The driven roller 201 is urged in the arrow direction by a tension urging unit 202 and applies a predetermined tension to the substrate 175. The tension urging unit 202 releases the urging for tension, for example, at the time of replacing the substrate 175, allowing easy replacement of such as the substrate 175.

The first power source 25 provides a voltage of a frequency ω1, the second power source 26 provides a voltage of a frequency of ω2, and these voltages generate an electric field V where the frequencies ω1 and ω2 are superposed in the discharge space 23. The electric field V plasmatizes the mixed gas G to deposit a film (a hard carbon-containing layer) on the surface of the substrate 175, corresponding to the raw material gas contained in the mixed gas G.

Herein, the hard carbon-containing layer may be deposited in lamination by the plural fixed electrodes disposed on the downstream side with respect to the rotation direction of the roll electrode, among the plural fixed electrodes, and by the mixed gas supply devices, so as to adjust the thickness of the hard carbon-containing layer.

Further, the hard carbon-containing layer may be deposited by the fixed electrodes disposed on the downstream side with respect to the rotation direction of the roll electrode, among the plural fixed electrodes, and by the mixed gas supply devices, while another layer, for example, a adhesive layer for improving the adhesion between the hard carbon-containing layer and the substrate, may be formed by the other fixed electrodes disposed on the upperstream side and by the mixed gas supply devices.

Still further, in order to improve the adhesion between the hard carbon-containing layer and the substrate, gas supply devices for supplying gas, such as argon gas or oxygen gas, and fixed electrodes may be arranged on the upstream side of the fixed electrodes and the mixed gas supply devices that form the hard carbon-containing layer, so as to perform plasma processing and thereby activating the surface of the substrate.

As described above, an intermediate transfer belt being an endless belt is tension supported by a pair of rollers; one of the pair of rollers is used as one of a pair of electrodes; at least one fixed electrode being the other electrode is provided along the outer circumferential surface of the roller which works s the one electrode; an electric filed is generated between the pair of electrodes at an atmospheric pressure or at a near atmospheric pressure to perform plasma discharge, so that a thin film is deposited and formed on the surface of the intermediate transfer member. Thus, it is possible is to provide an intermediate transfer member with a high transferability, a high cleaning performance and a high durability.

Further, as another embodiment, one of the roll electrode and fixed electrode may be grounded, while the other electrode being connected to the power source. As the power source in this case, the second power source is preferably employed to achieve delicate thin film forming, and particularly preferably employed in case of using rare gas, such as argon, as discharging gas.

Figure 4:
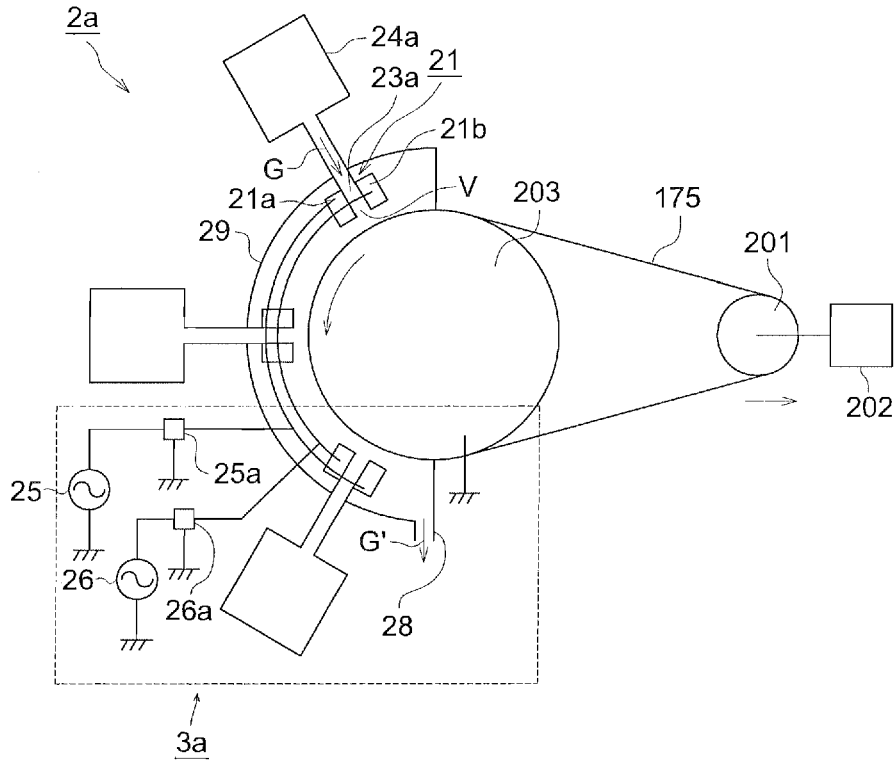
FIG. 4 is an illustration of a second manufacturing apparatus for manufacturing an intermediate transfer member.

FIG. 4 is an illustration of a second manufacturing apparatus for manufacturing an intermediate transfer member.

A second manufacturing apparatus 2*a* (a plasma jet type in which a discharge space and a thin film depositing area are different, and the plasma jet type jets plasma to a substrate) for an intermediate transfer member, which forms a hard carbon-containing layer on a substrate, includes: a roll 203 and a driven roller 201 that hang therearound a substrate 175 of an endless belt shaped intermediate transfer member and rotate it in the arrow direction; and an atmospheric pressure plasma CVD device 3*a* which is a film forming device for forming a hard carbon-containing layer on the surface of the substrate.

The atmospheric pressure plasma CVD device 3*a* is different from the atmospheric pressure plasma CVD device 3 in that they have different sections with respect to connection between power sources and electrodes; supplying of mixed gas; and depositing a film. Sections having differences will be described below.

The atmospheric pressure plasma CVD device 3*a* includes: at least one pair of fixed electrodes 21 disposed along the outer circumference of the roll 203; an electric discharge space 23*a* which is a facing area between, among the fixed electrodes 21, one fixed electrode 21*a* and the other fixed electrode 21*b* where electric discharge is performed; a mixed gas supply device 24*a* which produces a mixed gas G of at least a raw material gas and a discharging gas to supply the mixed gas G to the discharge space 23*a*; an electric discharge container 29 which reduces air flow into, for example, the discharge space 23*a*; a first power supply 25 connected to the one fixed electrode 21*a*; a second power source 26 connected to the other fixed electrode 21*b*; and a gas exhaustion section 28 for exhausting gas G' having been used out.

The mixed gas supply device 24*a* supplies a mixed gas of a raw material gas and nitrogen gas or a rare gas such as argon gas, to the discharge space 23*a*, the raw material gas forming at least one film selected from an amorphous carbon film, hydrogenated amorphous carbon film, tetrahedral amorphous carbon film, nitrogen-containing amorphous carbon film, metal-containing amorphous carbon film.

The first power source 25 provides a voltage of a frequency ω1, the second power source 26 provides a voltage of a frequency of ω2 higher than the frequency ω1, and these voltages generate an electric field V where the frequencies ω1 and ω2 are superposed in the discharge space 23*a*. The electric field V plasmatizes (excites) the mixed gas G and jets the plasmatized (excited) mixed gas to the surface of the substrate 175 to deposit a film (a hard carbon-containing layer) on the surface of the substrate 175, the film corresponding to the raw material gas contained in the plasmatized (excited) and jetted mixed gas.

Further, as another embodiment, one fixed electrode of the one pair of fixed electrodes may be grounded, while the other one fixed electrode being connected to the power source. As the power source in this case, the second power source is preferably employed to achieve delicate thin film forming, and particularly preferably employed in case of using rare gas, such as argon, as discharging gas.

Figure 5:
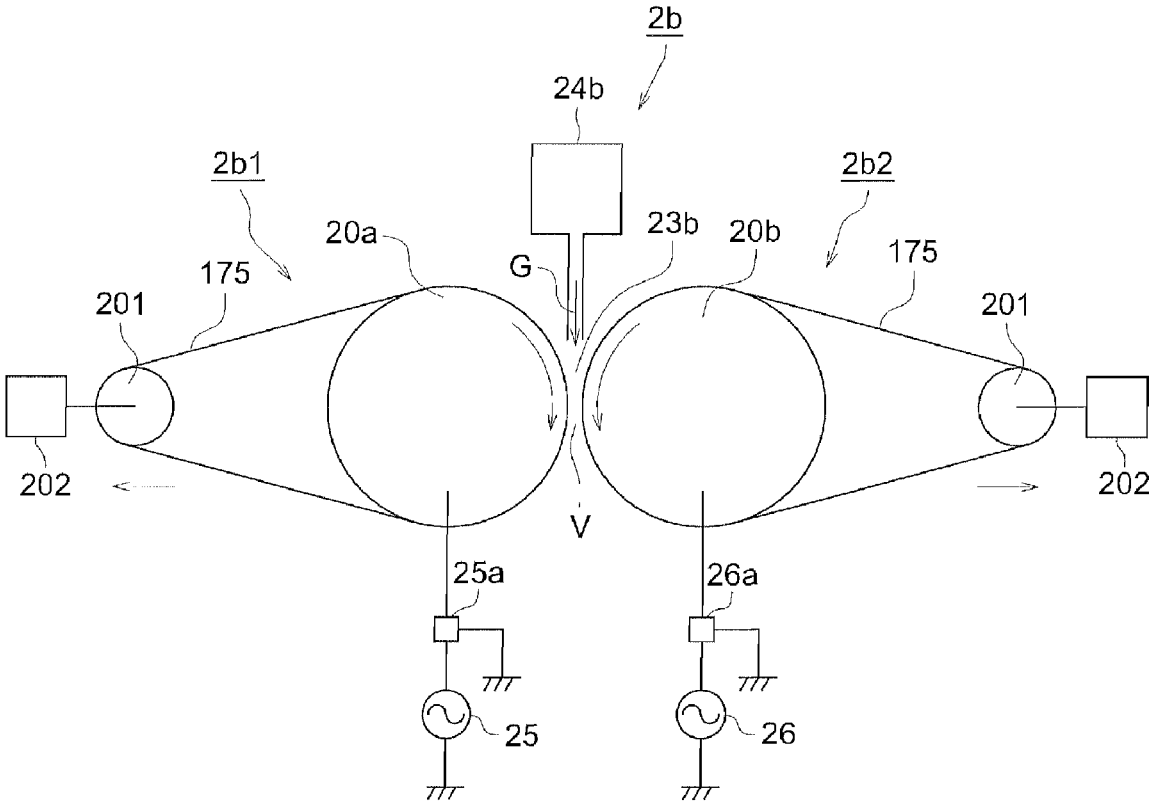
FIG. 5 is an illustration of a third manufacturing apparatus for manufacturing an intermediate transfer member.

FIG. 5 is an illustration of a third manufacturing apparatus for manufacturing an intermediate transfer member.

A third manufacturing apparatus 2*b* for an intermediate transfer member forms a hard carbon-containing layer on each of plural substrates simultaneously, and mainly includes plural film forming devices 2*b*1 and 2*b*2 each of which form a hard carbon-containing layer on each of the surfaces of the substrates.

The third manufacturing apparatus 2*b* (modification of a direct type, that performs electric discharge between facing roll electrodes to deposit a thin film) includes: a first film forming device 2*b*1; a second film forming device 2*b*2 being disposed in a substantial mirror image relationship at a predetermined distance from the first film forming device 2*b*1; and a mixed gas supply device 24*b* that produces a mixed gas G of at least a raw material gas and a discharging gas to supply the mixed gas C to an electric discharge space 23*b*, the mixed gas supply device 24*b* being disposed between the first film forming device 2*b*1 and the second film forming device 2*b*2.

The first film forming device 2*b*1 includes: a roll electrode 20*a* and a driven roller 201 that hang therearound a substrate 175 of an endless belt shaped intermediate transfer member and rotate it in the arrow direction; a tension urging unit 202 that urges the driven roller 201 in the arrow direction; and a first power source 2S connected to the roll electrode 20*a*. The second film forming device 2*b*2 includes: a roll electrode 20*b* and a driven roller 201 that hang therearound a substrate 175 of an intermediate transfer member in an endless form and rotate it in the arrow direction; a tension urging unit 202 that urges the driven roller 201 in the arrow direction; and a second power source 26 connected to the roll electrode 20*b*.

Further, the third manufacturing apparatus 2*b* includes an electric discharge space 23*b* where electric discharge is performed in a facing area between the roll electrode 20*a* and the roll electrode 20*b*.

The mixed gas supply device 24*a* supplies a mixed gas of a raw material gas and nitrogen gas or a rare gas such as argon gas, to the discharge space 23*b*, the raw material gas forming at least one film selected from an amorphous carbon film, hydrogenated amorphous carbon film, tetrahedral amorphous carbon film, nitrogen containing amorphous carbon film, metal-containing amorphous carbon film.

The first power source 25 provides a voltage of a frequency ω1, the second power source 26 provides a voltage of a frequency of ω2, and these voltages generate an electric field V where the frequencies ω1 and ω2 are superposed in the discharge space 23*b*. The electric field V plasmatizes (excites) the mixed gas G. The surfaces of the substrates 175 of the first film forming device 2*b*1 and the second film forming device 2*b*2 are exposed to the plasmatized (excited) mixed gas, so as to deposit and form respective films (hard carbon-containing layers) on the surfaces of the substrate 175 of the first film forming device 2*b*1 and substrate 175 of the second film forming device 2*b*2 simultaneously, corresponding to the raw material gas contained in the plasmatized (excited) mixed gas.

Herein, the facing roll electrode 20*a* and roll electrode 20*b* are disposed at a predetermined distance therebetween.

Further, as another embodiment, one roll electrode among the roll electrode 20*a* and roll electrode 20*b* may be grounded, while the other roll electrode being connected to a power source. As the power source in this case, the second power source is preferably employed to achieve delicate thin film forming, and particularly preferably employed in case of using rare gas, such as argon, as discharging gas.

Embodiments of various types of atmospheric pressure plasma CVD devices for forming a hard carbon-containing layer on a substrate will be described in detail below.

Figure 6:
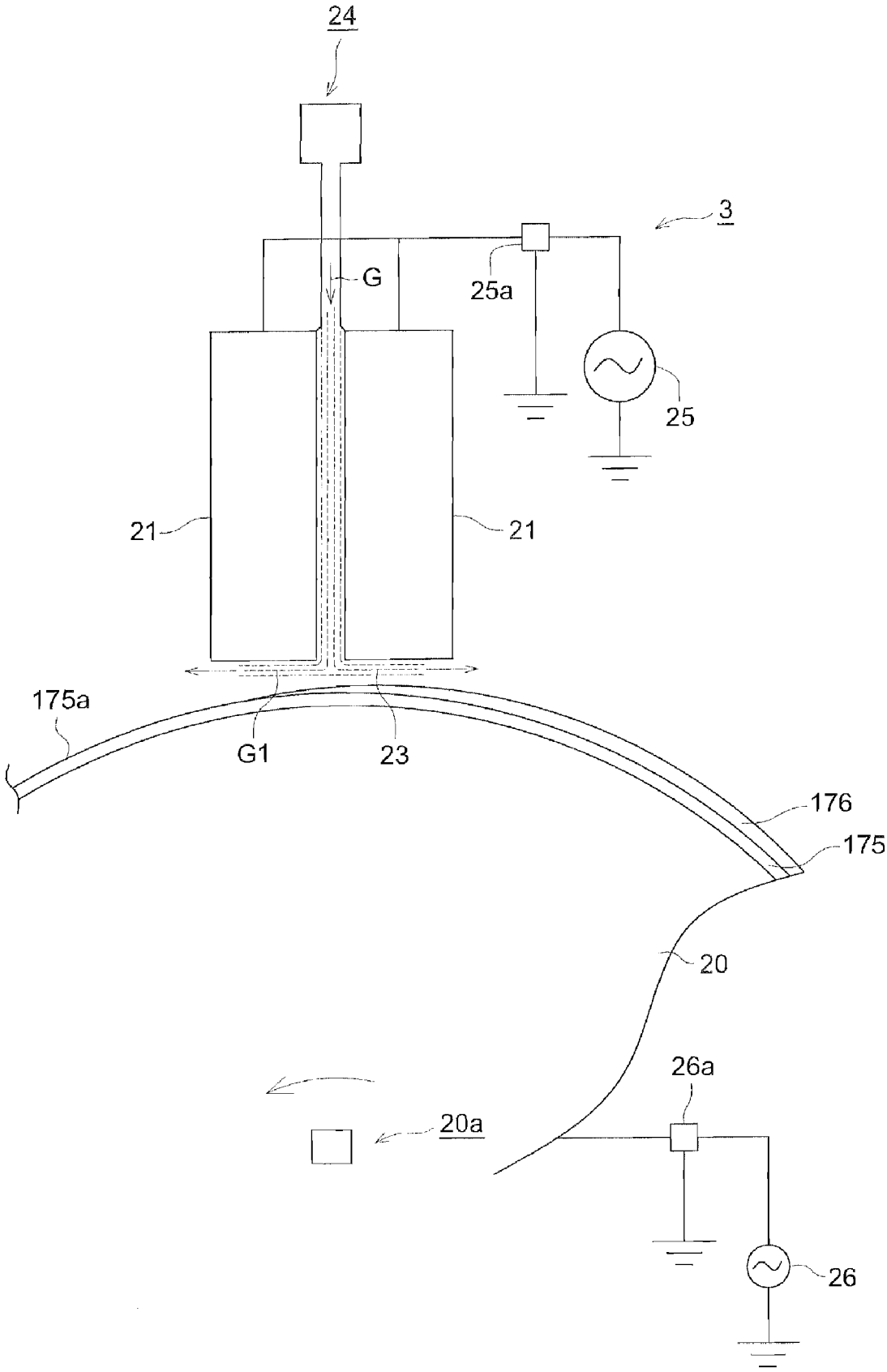
FIG. 6 is an illustration of a first plasma film forming device for manufacturing an intermediate transfer member by plasma.
Figure 7:
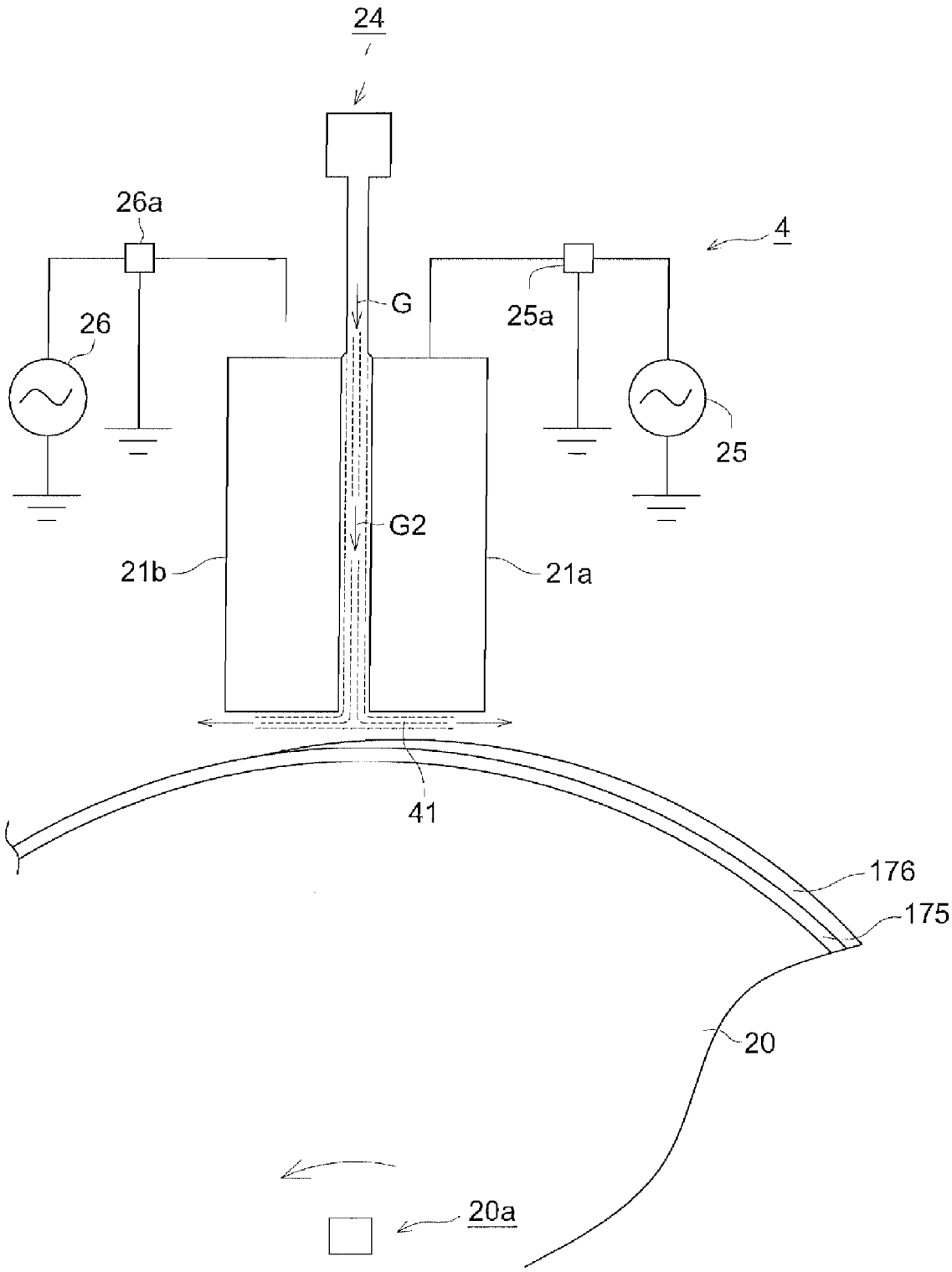
FIG. 7 is an illustration of a second plasma film forming device for manufacturing an intermediate transfer member by plasma.

Herein, FIGS. 6 and 7 are primarily extractions of the sections enclosed by the dashed lines in FIGS. 3 and 4.

FIG. 6 is an illustration of a first plasma film forming device for manufacturing an intermediate transfer member by plasma.

Referring to FIG. 6, an example of an atmospheric pressure plasma CVD device which is preferably used to form a hard carbon-containing layer in a first embodiment (a direct type) will be described.

An atmospheric pressure plasma CVD device 3 includes at least one pair of rollers for hanging a substrate therearound attachably and detachably and rotationally drive the substrate, and includes at least one pair of electrodes for performing plasma discharge, wherein one electrode of the pair of electrodes is one roller of the pair of rollers, and the other electrode is a fixed electrode facing the one roller through the substrate. The atmospheric pressure plasma CVD device 3 constitutes a manufacturing apparatus, for an intermediate transfer member and exposes the substrate to plasma generated in the facing area between the one roller and the fixed electrode so as to deposit and form the hard carbon-containing layer. The atmospheric pressure plasma CVD device 3 is preferably used in a case of using nitrogen gas as discharging gas, for example, and applies a high voltage by one power source, and applies a high frequency by another power source so as to start and continue discharge stably.

The atmospheric pressure plasma CVD device 3 includes, as described above, a mixed gas supply device 24, fixed electrode 21, first power source 25, first filter 25*a*, roll electrode 20, drive unit 20*a* for rotationally driving the roll electrode in the arrow direction, second power source 26, and second filter 26*a*, and performs plasma discharge in the discharge space 23 to excite a mixed gas G of a raw material gas and discharge gas, and exposes the substrate surface 175*a* to the excited mixed gas G1 so as to deposit and form a hard carbon-containing layer 176 on the surface of the substrate.

A first high frequency voltage of a frequency of $\omega_1$ is applied to the fixed electrode 21 from the first power source 25, and a high frequency voltage of a frequency of $\omega_2$ is applied to the roll electrode 20 from the second power source 26. Thus, an electric field is generated between the fixed electrode 21 and the role electrode 20 where the frequency $\omega_1$ at an electric field intensity $V_1$ and the frequency $\omega_2$ at an electric field intensity $V_2$ are superposed. A current $I_1$ flows through the fixed electrode 21, a current $I_2$ flows through the roll electrode 20, and plasma is generated between the electrodes.

Herein, The relationship between the frequency $\omega_1$ and the frequency $\omega_2$, and the relationship between the electric field intensity $V_1$, the electric field intensity $V_2$, and the electric field intensity IV that starts discharge of discharge gas satisfy $\omega_1<\omega_2$, and satisfy $V_1 \geqq IV > V_2$ or $V_1 > IV \geqq V_2$, wherein the output density of the second high frequency electric field is greater than or equal to 1 W/cm$^2$.

As the electric field intensity IV that starts electric discharge of nitrogen gas is 3.7 kV/mm, it is preferable that at least the electric field intensity $V_1$ applied from the first power source 25 is 3.7 kV/mm or higher, and the electric field intensity $V_2$ applied from the second high frequency power source 60 is 3.7 kV/mm or lower.

As the first power source 25 (high frequency power source) applicable to the first atmospheric pressure plasma CVD device 3, commercially available ones including the following can be employed.

| Applied Power | | | |
|---|---|---|---|
| Source Symbol | Manufacturer | Frequency | Product |
| A1 | Shinko-Denki | 3 kHz | SPG3-4500 |
| A2 | Shinko-Denki | 5 kHz | SPG5-4500 |
| A3 | Kasuga-Denki | 15 kHz | AGI-023 |
| A4 | Shinko-Denki | 50 kHz | SPG50-4500 |
| A5 | Haiden-Kenkyusho | 100 kHz* | PHF-6k |
| A6 | Pearl Kogyo | 200 kHz | CF-2000-200k |
| A7 | Pearl Kogyo | 400 kHz | CF-2000-400k |

Shinko-Denki: Shinko Electric Co., Ltd.
Kasuga-Denki: Kasuga Electric Works Ltd.
Haiden-Kenkyusho: Haiden Laboratory
Pearl Kogyo: Pearl Kogyo Co., Ltd.

As the second power source 26 (high frequency power source), commercially available ones including the following can be employed.

| Applied Power | | | |
|---|---|---|---|
| Source Symbol | Manufacturer | Frequency | Product |
| B1 | Pearl Kogyo | 800 kHz | CF-2000-800k |
| B2 | Pearl Kogyo | 2 MHz | CF-2000-2M |
| B3 | Pearl Kogyo | 13.56 MHz | CF-5000-13M |
| B4 | Pearl Kogyo | 27 MHz | CF-2000-27M |
| B5 | Pearl Kogyo | 150 MHz | CF-2000-150M |

Regarding the above described power sources, the power source marked * is an impulse high frequency power source of Haiden Laboratory (100 kHz in continuous mode). The others are high frequency power sources which are capable of applying only continuous sine waves.

In accordance with the present invention, regarding the power supplied between the facing electrodes from the first and second power sources, a power (output density) higher than or equal to 1 W/cm$^2$ is supplied to the fixed electrode 21 so as to excite discharge gas, thereby generating plasma so as to form a thin film. The upper limit of the power to be supplied to the fixed electrode 21 is preferably 50 W/cm$^2$, and more preferably 20 W/cm$^2$. The lower limit is preferably 1.2 W/cm$^2$. Herein, the discharge area (cm$^2$) means the area of the region where discharge occurs at the electrode.

Further, by supplying also the roll electrode 20 with a power (output density) higher than or equal to 1 W/cm$^2$, the output density can be improved while maintaining the uniformity of the high frequency electric field. Thus, plasma with a more uniform high density can be generated, which improves both the film forming speed and the quality of the film. The power is preferably higher than or equal to 5 W/cm$_2$. The upper limit of the power to be supplied to the roll electrode 20 is preferably 50 W/cm$^2$.

Herein, the waveforms of high frequency electric fields are not particularly limited, and can be a continuous oscillation mode of a continuous sine wave form called a continuous mode, an intermittent oscillation mode that is called a pulse mode and performs ON/OFF intermittently, either of which may be employed. However, at least, the high frequency to be supplied to the roll electrode 20 is preferably a continuous sine wave to obtain a film which is more delicate with a good quality.

Further, the first filter 25*a* is provided between the fixed electrode 21 and the first power source 25 to allow a current from the first power source 25 to the fixed electrode 21 to flow easily, and the current from the second power source 26 is earthed to inhibit a current from the second power source 26 to the first power source 25. The second filter 26*a* is provided between the roll electrode 20 and the second power source 26 to allow the current from the second power source 26 to the roll electrode 20 to flow easily, and the current from the first power source 21 is earthed to inhibit a current from the first power source 25 to the second power source 26.

Regarding electrodes, it is preferable to employ electrodes capable of applying a high electric field, as described above, and maintaining a uniform and stable discharge state. For durability against discharge by a high electric field, the dielectric material described below is coated on the surface of at least one of the fixed electrode 21 and roll electrode 20.

In the above description, regarding the relationship between electrodes and power sources, the second power source 26 may be connected to the fixed electrode 21, and the first power source 25 may be connected to the roll electrode 20.

Further, as another embodiment, either the fixed electrode 21 or the roll electrode 20 may be connected to the earth, and the other electrode may be connected to a power source. As the power source in this case, the second power source is preferably employed to achieve delicate thin film forming, and particularly preferably employed in case of using rare gas, such as argon, as discharging gas.

FIG. 7 is an illustration of a second plasma film forming device for manufacturing an intermediate transfer member by plasma.

Referring to FIG. 7, an example of an atmospheric pressure plasma device which is used to form a hard carbon-containing layer in a second embodiment (a plasma jet type) will be described.

In an atmospheric pressure plasma device 4, an electric field, in which different frequencies generated between electrodes by plural power sources outputting different voltages and different frequencies are superposed, plasmatizes a mixed gas of at least a discharge gas and a raw material gas so as to deposit and form the hard carbon-containing layer. The atmospheric pressure plasma device 4 has a structure similar to that of the atmospheric pressure plasma CVD device 3 in FIG. 6 except the following points. That is, the atmospheric pressure plasma device 4 includes a pair of fixed electrodes 21*a* and 21*b* wherein a first filter 25*a* and a first power source 25 are connected to the fixed electrode 21*a*; a second filter 26*b* and a second power source 26 are connected to the fixed electrode 21*b*; and the roll electrode 20 is connected to the earth.

Operation of depositing and forming a hard carbon-containing layer 176 will be described below. A first high frequency voltage of a frequency of $\omega_1$ is applied to the fixed electrode 21*a* from the first power source 25, and a high frequency voltage of a frequency of $\omega_2$ is applied to the fixed electrode 21*b* from the second power source 26. Thus, an electric field is generated between the fixed electrode 21*a* and the fixed electrode 21*b* where the frequency $\omega_1$ at an electric field intensity $V_1$ and the frequency $\omega_2$ at an electric field intensity $V_2$ are superposed. A current $I_1$ flows through the fixed electrode 21*a*, a current $I_2$ flows through the fixed electrode 21*b*, and plasma is generated between the electrodes.

Then, a plasmatized mixed gas G2 is jetted to the surface of a substrate 175 in a thin film forming area 41 to deposit and form a hard carbon-containing layer 176.

Further, as another embodiment, one of the fixed electrode 21*a* and fixed electrode 21*b* may be connected to the earth, and the other electrode may be connected to a power source. As the power source in this case, the second power source is preferably employed to achieve delicate thin film forming, and particularly preferably employed in case of using rare gas, such as argon, as discharging gas.

Figure 8:
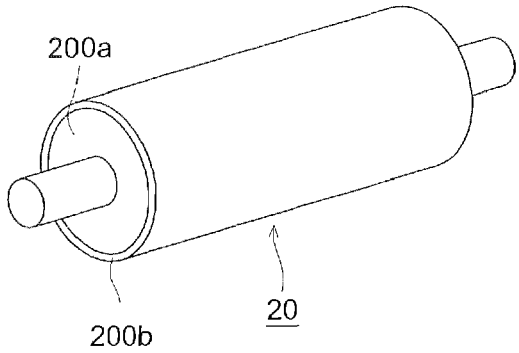
FIG. 8 is a schematic diagram showing examples of roll electrodes.
Figure 8:
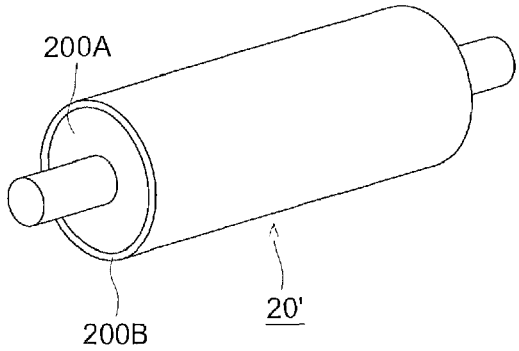

FIG. 8 is a schematic diagram showing examples of roll electrodes.

The structures of a roll electrode 20 will be described below. As shown in FIG. 8(*a*), a roll electrode 20 is constructed by combination of a conductive base material 200*a* (hereinafter, also referred to as "an electrode base material"), of metal or the like, onto which ceramic having been sprayed, and a ceramic-coated dielectric material 200*b* (hereinafter, also referred to merely as "a dielectric material") coated around the conductive base material 200*a*, the ceramic-coated dielectric material 200*b* having been sealed by the use of an inorganic material. As the ceramic material to be used for spraying, alumina, silicon nitride or the like is preferably used, and particularly, alumina is further preferably used because of easy workability.

Further, as shown in FIG. 8(*b*), a roll electrode 20' may be constructed by a combination of a conductive base material 200A of metal or the like and a lining-processed dielectric material 200B arranged with an inorganic material by lining, the lining-processed dielectric material 200B being coated around the conductive base material 200A. As the lining material, silicate glass, borate glass, phosphate glass, germinate glass, tellurite glass, aluminate glass, vanadate glass or the like is preferably used, and particularly, borate glass is further preferably used because of easy workability.

Conductive base materials 200*a* and 200A of metal or the like can be made from silver, platinum, stainless steel, aluminum, iron steel or the like, and stainless steel is preferable because of easy workability.

In the present embodiment, a stainless-steel jacket-roll base material (not shown) provided with cooling means by cooling water is used for the base material 200*a* and 200A of the roll electrodes.

Figure 9:
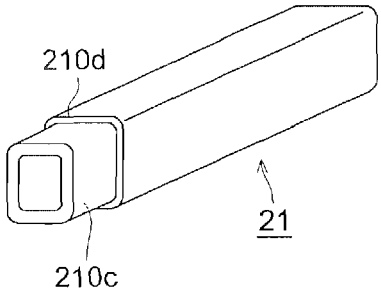
FIG. 9 is a schematic diagram showing examples of fixed electrodes.
Figure 9:
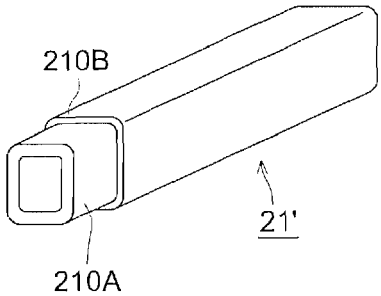

FIG. 9 is a schematic diagram showing examples of fixed electrodes.

In FIG. 9(*a*), fixed electrodes 21, 21*a* and 21*b* of a rectangular cylinder or rectangular tube are constructed, similarly to the above described roll electrode 20, by combination of a conductive base material 210*c*, of metal or the like, onto which ceramic having been sprayed, and a ceramic-coated dielectric material 210*d* coated around the conductive base material 210*c*, the ceramic-coated dielectric material 210*d* having been sealed by the use of an inorganic material. Further, as shown in FIG. 9(*b*), a fixed electrode 21' of a rectangular cylinder or rectangular tube may be constructed by combination of a conductive base material 210A, of metal or the like, and a lining-processed dielectric material 210B coated around the conductive base material 210A, the lining-processed dielectric material 210B having being arranged with an inorganic material by lining.

An example of a film forming process will be described below, referring to FIGS. 3 and 6. Herein, the film forming process is a part of a process of a manufacturing method for an intermediate transfer member; includes at least one process of forming at least one layer on a substrate; is arranged as the last process; and deposits and forms a hard carbon-containing layer 176 on the substrate 175.

In FIGS. 3 and 6, a substrate 175 is tension supported around the roll electrode 20 and the driven roller 201, then a predetermined tension is applied to the substrate 175 by operation of the tension urging unit 202, and thereafter, the roll electrode 20 is rotationally driven at a predetermined rotation speed.

The mixed gas supply device 24 produces a mixed gas G and sends out the mixed gas G into the electric discharge space 23.

A voltage of a frequency of $\omega_1$ is output from the first power source 25 to be applied to the fixed electrode 21, and a voltage of a frequency of $\omega_2$ is output from the second power source 26 to be applied to the roll electrode 20. These voltages generate an electric field V in the discharge space 23 with the frequency $\omega_1$ and the frequency of $\omega_2$ superposed with each other.

The mixed gas G sent out to the discharge space 23 is excited by the electric field V to be turned into a plasma state. Then, the surface of the substrate is exposed to the mixed gas G in the plasma state, and a raw material gas in the mixed gas G forms on the substrate 175 at least one film, that is a hard carbon-containing layer 176, selected from an amorphous carbon film, hydrogenated amorphous carbon film, tetrahedral amorphous carbon film, nitrogen-containing amorphous carbon film, and metal-containing amorphous carbon film.

In FIGS. 4 and 7, a voltage of a frequency of $\omega_1$ is output from the first power source 25 to be applied to the fixed electrode 21, and a voltage of a frequency of $\omega_2$ is output from the second power source 26 to be applied to the fixed electrode 21*b*. These voltages generate an electric field V in the discharge space 23*a* with the frequency $\omega_1$ and the frequency of $\omega_2$ superposed with each other.

The electric field V excites a mixed gas G passing the discharge space 23 to turn the gas C into a plasma state, and the plasmatized mixed gas G2 is jetted out to the thin film forming area 41 where the surface of a substrate is exposed to the mixed gas G. A raw material gas in the mixed gas G2 forms on the substrate 175 at least one film, that is a hard carbon-containing layer 176, selected from an amorphous carbon film, hydrogenated amorphous carbon film, tetrahedral amorphous carbon film, nitrogen-containing amorphous carbon film, and metal-containing amorphous carbon film.

As a result of analysis by Raman Spectroscopic Method and IR absorption Method, it is obvious that, in the hard carbon-containing layer formed in this way, interatomic bonds with hybrid orbitals of $SP_3$ and interatomic bonds with hybrid orbitals of $SP_2$ exist in mixture, the orbitals being formed by respective carbon atoms. The ratio between the $SP_3$ bond and the $SP_2$ bond can be approximately estimated by peak split of IR specta. In IR spectra, although spectra of various modes of superposed spectra can be measured in a range 2800 to 3150/cm, the attribution of peak that corresponds to each wave number is apparent. Peak separation is performed according to Gauss distribution, the respective peak areas are calculated, the ratio between the peak areas is obtained, and thus $SP_3/SP_2$ is obtained. Further, according to X-ray and electronic diffraction analysis, it is proved that it is in a state containing microcrystalline particles in amorphous state (a-C:H) and microcrystalline particles of a size in an approximate range from 50 Å to several μm, or in an amorphous state containing either.

As an embodiment from a point of view of a hard carbon-containing layer, a hard carbon-containing layer of a diamond state carbon is formed on the surface of a substrate 175, according to a method in accordance with the present embodiment. This hard carbon-containing layer made from the diamond state carbon refers to an amorphous carbon film formed by a hard carbon called carbon or amorphous carbon, hydrogenated amorphous carbon, tetrahedral amorphous carbon, nitrogen-containing amorphous carbon, or metal-containing amorphous carbon, with primarily SP3 bond between carbon. This hard carbon-containing layer is extremely hard and excellent in durability, and further has an extremely smooth morphology with a high transferability.

For example, in the above described atmospheric pressure plasma CVD device 3, a mixed gas (discharge gas) is plasma-excited by a pair of electrodes (the roll electrode 20 and the fixed electrode 21), and a raw material gas containing carbon atomics containing carbon atomics present in the plasma is ionized to expose the surface of a substrate 175 thereto. The carbon ions to which the surface of the substrate 175 has been exposed bond with each other in the neighborhood. Thus, a hard carbon-containing layer of extremely delicate diamond state carbon is formed on the surface of the substrate 175.

A discharge gas refers to a gas that is plasma-excited in the above described conditions, and can be nitrogen, argon, helium, neon, krypton, xenon or the like, or a mixture of these.

As a raw material gas for forming a hard carbon-containing layer, an organic compound gas being in a gas or liquid state at room temperature is used, and particularly, a hydrocarbon gas is used. The phase state of these raw materials is not necessary to be a gas phase at normal temperature and pressure. A raw material capable of being vaporized through melting, evaporating, sublimation or the like by heating or pressure reducing by the mixed gas supply device 24 can be used either in a liquid phase or solid phase. Regarding hydrocarbon gas as a raw material gas, a gas can be used which contains at least any kind of hydrocarbon gases including, for example, paraffinic hydrocarbon, such as $CH_4$, $C_2H_6$, $C_3H_8$, $C_4H_{10}$ or the like, acetylene hydrocarbon, such as $C_2H_2$, $C_2H_4$ or the like, olefin hydrocarbon, diolefin hydrocarbon, further aromatic hydrocarbon and the like. Further, in addition to hydrocarbon, a compound can be used that contains at least carbon element, for example, alcohols, ketones, ethers, esters, CO, $CO_2$ or the like.

Further, although these raw materials may be used alone, a mixture of more than one component may be used.

By the method as described above, a hard carbon-containing layer of a diamond state carbon is formed on the surface of a substrate 175, which achieves an intermediate transfer member with a high transferability and a high cleanability and durability, and further maintains transparency of the substrate 175.

The film thickness and film quality of the hard carbon-containing layer depend on the output of power source for generating a high frequency electric field, supply gas flow rate, plasma generating time period, self-bias generated at the electrodes kind of the raw material gas and the like. Increase in the high frequency output, decrease in supply gas flow rate, increase in self-bias, decrease in carbon number of the raw material, and the like all greatly influence hardening, improvement in delicacy, increase in compressive stress, and brittleness of the hard carbon-containing layer.

Regarding the composition of raw material gas for forming a hard carbon film, amorphous carbon with a low hydrogen containing rate can be formed by using hydrocarbon gas alone. Carbon element containing compounds other than hydrocarbon compounds, for example, alcohols, ketones, ethers and the like can be used alone to obtain amorphous carbon. Further, hydrogenated amorphous carbon can be obtained by adding hydrogen simultaneously. Still further, metallic amorphous carbon can be obtained by adding organic metal simultaneously.

EXAMPLES

Regarding effects of a case of forming a hard carbon-containing layer on the surface of each of substrates of various kinds having no hard carbon-containing layer, comparative tests were carried out under the following conditions, which will be described below.

The film thicknesses of prepared DLCs were all made 20 nm in the following Inventive Examples (the same film thickness in Inventive Examples 1 to 9). Film forming time was adjusted, and film thickness was evaluated by TEM.

(1) Preparation of Samples

The following samples were prepared, as conditions are indicated in Table 1 and Table 2 shown later.

1) Inventive Example 1

[Plasma Film Forming Device]

The plasma CVD device in FIG. 3 was used; the pressure in the electric discharge space 23 was set to 13.3 Pa; and an output density of 3.2 W/cm$^2$ was set for the fixed electrode 21, applying a high frequency voltage of 13.56 MHz to the power source 25. The power source 26 was not used and was grounded.

[Preparation of Hard Carbon Film]

<Belt Substrate>

Carbon dispersed polyimide belt of a volume resistance of $10^{10}$ Ω·cm

<Mixed Gas Composition> electric discharge gas: argon 97.9 volumes carbon hard film forming gas: methane 2.1 volume %

A carbon hard film was formed on the belt substrate under the above described conditions, and thus Sample 1 was prepared.

[Evaluation]

| | |
|---|---|
| <Composition> | XPS measurement |
| <Hardness> | nanoindentation |
| <density> | thin film X-ray |
| <$Sp_3$ ratio> | Raman analysis |

2) Inventive Example 2

A hard carbon-containing layer was formed on a substrate by the plasma film forming device shown in FIG. 3 at a reduced pressure (13.3 Pa).

The test as carried out in the same manner as Inventive Example 1 except that the mixed gas composition was set to the following, and thus Sample 2 was prepared.

electric discharge gas: argon 97.9 volumes carbon hard film forming gas: n-hexanone 1.1 volume % additive gas: hydrogen 1.0 volume %

3) Inventive Example 3

[Plasma Film Forming Device]

The plasma CVD device in FIG. 3 was used; the pressure in the discharge space 23 was set to the atmospheric pressure; and the output density was set to 5 W/cm$^2$ for the fixed electrode 21, applying a high frequency voltage of 13.56 MHz to the power source 25. The output density was set to 1.5 W/cm$^2$ for the roll electrode 20, applying a high frequency voltage of 50 KHz to the power source 26.

[Preparation of Hard Carbon Film]

<Belt Substrate>

Carbon dispersed polyimid belt of a volume resistance of $10^{10}$ Ω·cm.

<Mixed Gas Composition> electric discharge gas: nitrogen 98.4 volume % carbon hard film forming gas: methane 1.6 volume %

A carbon hard film was formed on the belt substrate under the above described conditions, and thus Sample 3 was prepared.

4) Inventive Example 4

The plasma CVD device in FIG. 4 was used; the pressure in the discharge space 23*a* was set to the atmospheric pressure; and the output density was set to 5 W/cm$^2$ for the fixed electrode 21*a*, applying a high frequency voltage of 13.56 MHz to the power source 25. The output density was set to 3 W/cm$^2$ for the fixed electrode 21*b*, applying a high frequency voltage of 50 KHz to the power source 26. The test was carried out in the same manner as Inventive Example 3 except the above described, and thus Sample 4 was prepared.

5) Inventive Example 5

The plasma CVD device in FIG. 5 was used; the pressure in the discharge space 23*b* was set to the atmospheric pressure; and the output density was set to 5 W/cm$^2$ for the roll electrode 20*a*, applying a high frequency voltage of 13.56 MHz to the power source 25. The output density was set to 1.5 W/cm$^2$ for the roll electrode 20*b*, applying a high frequency voltage of 50 KHz to the power source 26. The test was carried out in the same manner as Inventive Example 3 except the above described, and thus Sample 5 was prepared.

6) Inventive Example 6

[Plasma Film Forming Device]

The plasma CVD device in FIG. 3 was used; the pressure in the discharge space 23 was set to the atmospheric pressure; and the output density was set to 4 W/cm$^2$ for the fixed electrode 21, applying a high frequency voltage of 13.56 MHz to the power source 25. The output density was set to 1.3 W/cm$^2$ for the roll electrode 20, applying a high frequency voltage of 50 KHz to the power source 26.

[Preparation of Hard Carbon Film]

<Belt Substrate>

Carbon dispersed polycarbonate belt of a volume resistance of $10^{10}$ Ω·cm.

<Mixed Gas Composition> electric discharge gas: nitrogen 95.5 volume % carbon hard film forming gas: n-hexanone 2.0 volume % additive gas: hydrogen 2.5 volumes

A carbon hard film was formed on the belt substrate under the above described conditions, and thus Sample 6 was prepared.

7) Inventive Example 7

The plasma CVD device in FIG. 5 was used; the pressure in the discharge space 23*b* was set to the atmospheric pressure; and the output density was set to 4 W/cm$^2$ for the roll electrode 20*a*, applying a high frequency voltage of 13.56 MHz to the power source 25. The output density was set to 13 W/cm$^2$ for the roll electrode 20*b*, applying a high frequency voltage of 50 KHz to the power source 26. The test was carried out in the same manner as Inventive Example 5 except the above described, and thus Sample 7 was prepared.

8) Inventive Example 8

[Plasma Film Forming Device]

The plasma CVD device in FIG. 3 was used; the pressure in the discharge space 23 was set to the atmospheric pressure;

and the output density was set to 5 W/cm$^2$ for the fixed electrode 21, applying a high frequency voltage of 13.56 MHz to the power source 25. The output density was set to 1.5 W/cm$^2$ for the roll electrode 20, applying a high frequency voltage of 50 KHz to the power source 26.

[Composition of Hard Carbon Film]

<Belt Substrate>

Carbon dispersed polyphenylene sulfide belt of a volume resistance of $10^{10}$ Ωcm.

<Mixed Gas Composition> electric discharge gas: nitrogen 98.4 volume % carbon hard film forming gas: $CH_4$ 1.6 volume %

A carbon hard film was formed on the belt substrate under the above described conditions, and thus Sample 8 was prepared.

9) Inventive Example 9

The plasma CVD device in FIG. 5 was used; the pressure in the discharge space 23*b* was set to the atmospheric pressure; and the output density was set to 5 W/cm$^2$ for the roll electrode 20*a*, applying a high frequency voltage of 13.56 MHz to the power source 25. The output density was set to 5 W/cm$^2$ for the roll electrode 20*b*, applying a high frequency voltage of 50 KHz to the power source 26. The test was carried out in the same manner as Inventive Example 8 except the above described, and thus Sample 9 was prepared.

For comparison with the above described Inventive Examples, samples of substrates alone were prepared. Herein, as a comparative example using the same substrate, Comparative Example 1 was made in comparison with Inventive Examples 1 to 5 using polyimide for a substrate. Further, Comparative Example 2 was made in comparison with Inventive Examples 6 and 7 using polycarbonate for a substrate. Still further, Comparative Example 3 was made in comparison with Inventive Examples 8 and 9 using polyphenylene sulfide for a substrate.

10) Comparative Example 1

A polyimide substrate sheet before forming a hard carbon-containing layer was prepared. Comparison is made with the above described Inventive Examples 1 to 5.

11) Comparative Example 2

A polycarbonate substrate sheet before forming a hard carbon-containing layer was prepared. Comparison was made with the above described Inventive Examples 6 and 7.

12) Comparative Example 3

A polyphenylene sulfide substrate sheet before forming a hard carbon-containing layer was prepared. Comparison was made with the above described Inventive Examples 8 and 9.

TABLE 1

| Sample | Pressure Pa | Raw material | Frequency MHz | Type | Substrate |
|---|---|---|---|---|---|
| Inv. 1 | 13.3 | $CH_4$ | 13.56 | direct | polyimide |
| Inv. 2 | 13.3 | n-hexanone | 13.56 | direct | polyimide |
| Inv. 3 | atmospheric pressure | $CH_4$ | 13.56 | direct | polyimide |

TABLE 1-continued

| Sample | Pressure Pa | Raw material | Frequency MHz | Type | Substrate |
|---|---|---|---|---|---|
| Inv. 4 | atmospheric pressure | $CH_4$ | 13.56 | jet | polyimide |
| Inv. 5 | atmospheric pressure | $CH_4$ | 13.56 | facing roll | polyimide |
| Comp. 1 | no hard carbon-containing layer | | | | polyimide |
| Inv. 6 | atmospheric pressure | n-hexanone | 13.56, 50 kHz | direct | polycarbonate |
| Inv. 7 | atmospheric pressure | n-hexanone | 13.56, 50 kHz | facing roll | polycarbonate |
| Comp. 2 | no hard carbon-containing layer | | | | polycarbonate |
| Inv. 8 | atmospheric pressure | $CH_4$ | 13.56 | direct | Polyphenylene sulfide |
| Inv. 9 | atmospheric pressure | $CH_4$ | 13.56 | facing roll | Polyphenylene sulfide |
| Comp. 3 | no hard carbon-containing layer | | | | Polyphenylene sulfide |

Inv.: Inventive Example, Comp.: Comparative Example

Herein, $Sp_3$ ratio is a ratio between hybrid orbitals of and hybrid orbitals of $SP_2$ measured by Raman analysis. Raman spectra are split into D band around 1390 cm$^{-1}$ and C band around 1530 cm$^{-1}$, and the ratio $Sp_3/Sp_2$ was evaluated based on the relative intensity ($I_D/I_G$).

TABLE 2

| Sample | Carbon concentration [at. %] | Hardness [GPa] | density [g/cm$^3$] | $SP_3$ ratio |
|---|---|---|---|---|
| 1 | 95 | 17 | 2.6 | 0.71 |
| 2 | 75 | 9 | 2.0 | 0.65 |
| 3 | 99 | 20 | 3.0 | 0.78 |
| 4 | 90 | 12 | 2.7 | 0.60 |
| 5 | 99 | 20 | 2.9 | 0.77 |
| 6 | 71 | 7 | 1.9 | 0.60 |
| 7 | 70 | 6 | 1.9 | 0.51 |
| 8 | 98 | 18 | 2.8 | 0.76 |
| 9 | 98 | 19 | 2.9 | 0.77 |

(2) Sample Evaluation

An evaluation result of the above described samples will be described below.

For the secondary transfer efficiency, image forming on a predetermined number of sheets was performed by a copier, and the image density was measured before and after the image forming on the predetermined number of sheets to calculate the transfer rate.

For the state of the surface of an intermediate transfer member, image forming on a predetermined number of sheets was performed, and thereafter, the state of toner deposited was examined by visual observation of the intermediate transfer member. "A" represents a case of state free from toner deposits, "B" represents a case of a slight presence of toner deposits, which is practically acceptable, and "C" represents a case of practically unacceptable.

Further for the image quality, image forming on a predetermined number of sheets was performed, sampling was made appropriately in the meantime, and the state of hollow defects was confirmed by visually observing the images formed on the sheets. "A" represents a case of a state free from hollow defects, "B" represents a case of a slight presence of hollow defects, which is practically acceptable, and "C" represents a case of practically unacceptable.

TABLE 3

| Sample | Number of sheets for duration test | secondary transfer efficiency % Initial | After duration test | Intermediate transfer member Surface state | Image quality |
|---|---|---|---|---|---|
| Inventive Example 1 | 50 | 97 | 95 | B | B |
| Inventive Example 2 | 40 | 96 | 94 | B | B |
| Inventive Example 3 | 50 | 99 | 97 | A | B |
| Inventive Example 4 | 40 | 97 | 95 | B | B |
| Inventive Example 5 | 45 | 98 | 97 | A | B |
| Comparative Example 1 | 30 | 94 | 89 | C | C |
| Inventive Example 6 | 20 | 96 | 94 | B | B |
| Inventive Example 7 | 18 | 95 | 94 | B | B |
| Comparative Example 2 | 10 | 89 | 85 | C | C |
| Inventive Example 8 | 30 | 98 | 97 | A | B |
| Inventive Example 9 | 25 | 97 | 96 | B | B |
| Comparative Example 3 | 15 | 90 | 85 | C | C |

Following are the results of the above.

1) Regarding a substrate alone (Comparative Examples 1 to 3) on which no hard carbon-containing layer is formed:

for polyimide, duration test with 300,000 sheets proved that the secondary transfer efficiency degraded by 5, and, further, toner deposition and hollow defects were observed;

for polycarbonate, duration test with 100,000 sheets proved that the secondary transfer efficiency degraded by 4', and, further, toner deposition and hollow defects were observed; and for polyphenylene sulfide, duration test with 150,000 sheets proved that the secondary transfer efficiency drops 5%, and, further, toner deposition and hollow defects were observed.

Accordingly, it was confirmed that using a substrate alone showed a problem on each of the evaluation items.

2) In contrast, duration tests with 500,000 to 400,000 sheets as shown in Inventive Examples 1 to 5 for polyimide, duration tests with 200,000 to 180,000 sheets as shown in Inventive Examples 6 and 7 for polycarbonate, and duration tests with 150,000 to 100,000 sheets as shown in Inventive Examples 8 and 9 for polyphenylene sulfide, proved that the transfer efficiency was within a range of 1-2% in all Inventive Examples 1 to 9; no toner deposits were on the surface in all the Inventive Examples; and, in terms of image quality, no hollow defects occurred in all the Inventive Examples. Thus, it was confirmed that forming a hard carbon-containing layer was effective.

3) Further, particularly regarding toner deposits, film forming by a plasma discharge at a reduced pressure showed preferable results as shown in Inventive Examples 1 and 3, however, it was also confirmed that film forming by a plasma discharge at an atmospheric pressure gave further effective results.

4) As has been described, it was confirmed that formation of a hard carbon-containing layer on the surface of a substrate by a plasma discharge film forming device exhibited desired effects on an intermediate transfer member.

What is claimed is:

1. An intermediate transfer member which holds a toner image transferred from a first toner image carrier and secondarily transfers the toner image to a surface of an image forming material, comprising a substrate having thereon at least a hard carbon-containing layer, and the hard carbon-containing layer has a carbon concentration of 30 to 100%, hardness of 5 to 50 GPa, and density of 1.2 to 3.2 g/cm3.

2. The intermediate transfer member of claim 1, wherein an outer surface of the intermediate transfer member is the hard carbon-containing layer.

3. The intermediate transfer member of claim 1, wherein the hard carbon-containing layer comprises at least one film selected from the group consisting of an amorphous carbon film, a hydrogenated amorphous carbon film, a tetrahedral amorphous carbon film, a nitrogen-containing amorphous carbon film and a metal-containing amorphous carbon film.

4. The intermediate transfer member of claim 1, wherein the hard carbon-containing layer is formed on surface of the substrate by:

exciting at least a raw material gas for forming the hard carbon-containing layer between a pair of electrodes by a plasma discharge generated in a vicinity of the surface of the substrate; and exposing the surface of the substrate to the exited raw material gas.

5. The intermediate transfer member of claim 1, wherein the hard carbon-containing layer is formed on a surface of the substrate by:

exciting at least a raw material gas for forming the hard carbon-containing layer by a plasma discharge: and jetting the excited raw material gas onto the surface of the substrate.

6. The intermediate transfer member claim 4, wherein the hard carbon-containing layer is formed at an atmospheric pressure or a near atmospheric pressure.

* * * * *